US005620211A

United States Patent [19]

Ellis

[11] Patent Number: 5,620,211

[45] Date of Patent: Apr. 15, 1997

[54] LATCH WITH ADJUSTABLE BACKSET

[75] Inventor: Philip C. Ellis, Reading, Pa.

[73] Assignee: Baldwin Hardware Corporation, Reading, Pa.

[21] Appl. No.: 549,411

[22] Filed: Oct. 27, 1995

[51] Int. Cl.[6] ..... E05C 1/00

[52] U.S. Cl. ..... 292/1.5; 292/169.21; 292/DIG. 52

[58] Field of Search ..... 292/1.5, 169.21, 292/DIG. 52, DIG. 60

[56] References Cited

U.S. PATENT DOCUMENTS

| | | | |
|---|---|---|---|
| 4,662,665 | 5/1987 | Lin | 292/167 |
| 4,687,239 | 8/1987 | Lin | 292/172 |
| 4,711,477 | 12/1987 | Fann et al. | 292/169.14 |
| 4,767,140 | 8/1988 | Lin | 292/337 |
| 4,890,871 | 1/1990 | Lin | 292/337 |
| 5,020,837 | 6/1991 | Lin | 292/169.13 |
| 5,074,605 | 12/1991 | Fann et al. | 292/337 |
| 5,149,151 | 9/1992 | Shen | 292/1.5 |
| 5,169,184 | 12/1992 | Bishop | 292/1.5 |
| 5,257,838 | 11/1993 | Lin | 292/1.5 |
| 5,354,109 | 10/1994 | Lin | 292/1.5 |
| 5,490,695 | 2/1996 | Shiue | 292/1.5 |
| 5,551,736 | 9/1996 | Fann et al. | 292/1.5 |

*Primary Examiner*—Rodney M. Lindsey
*Assistant Examiner*—Donald J. Lecher
*Attorney, Agent, or Firm*—Myron B. Kapustij; Malcolm L. Sutherland

[57] ABSTRACT

The adjustable latch bolt of this invention features a novel cam actuating assembly which permits election of one of two door knob spindle backsets which are in standard usage. The cam assembly is comprised of two half hubs, each having one arm so that one half hub operates the drawbar in one direction of rotation and the other in the opposite direction of rotation. The half hubs are formed so that a portion of one half hub nests in a depression in the other in such a way that the two half hubs can rotate relative to each other. When the hubs are set to one of two backsets and are in a position to actuate the drawbar, non-circular openings passing through the axis of rotation of the two hubs are aligned so that a complementary shaped spindle can pass through both hubs and engage them for rotation. With the spindle in place the two half hubs are prevented from rotation relative to each other. In this condition, the distance between the two arms is greater than the distance between detents on the drawbar and the cam assembly cannot be moved from one backset position to another. With the spindle removed the two half hubs can be rotated relative to each other so that the distance between the arms is less than the distance between the detents on the drawbar and the cam assembly is able to pass between the detents from one backset position to another.

10 Claims, 5 Drawing Sheets

LATCH WITH ADJUSTABLE BACKSET

FIELD OF THE INVENTION

The present invention relates to a latch assembly for mounting in a bore extending in from a side edge of a door and operable by handles on opposing sides of the door. The latch assembly has a backset adjustment, the backset being the distance from the side edge of the door to a rotational axis of the handles or a keylock.

BACKGROUND OF THE INVENTION

The distance from the edge of a door to the center of rotation of the door knob or lever is called the "backset". In the United States, doors are commonly available in two backsets, 2⅜" and 2¾". Until recently, it was customary for hardware companies to produce locks in both backsets, and retailers would stock both types. Now, however, large retailers wish to limit the number of types of each product they have to stock, so they are demanding that their vendors supply locks that can be easily adjusted to fit either backset. The current invention provides a method for doing so.

The latch of the instant invention is of the type commonly referred to as a "tubular latch", meaning that the operating mechanism is contained within a case that can be inserted axially into a hole (usually 1" in diameter) drilled in the edge of the door. In its most basic form, it consists of a spring loaded bolt that extends from the edge of the door and engages a hole in the strike plate attached to the door jamb. To open the door, the bolt is withdrawn by turning a handle that is attached to a cam that rotates in the latch case and engages detents on a drawbar that is attached to the bolt head. Since the backset is the distance from the edge of the door to the center of rotation of the knob and, by extension, the cam, the backset can be adjusted either by moving the front of the case and the bolt head to either of two positions relative to the cam center line, or by providing two sets of detents and a means of moving the cam so that it engages either one or the other. Both types are currently in use. The invention described here belongs to the latter group.

If the cams are to engage the detents in order to operate the latch, but be able to move from one set of detents to the other to adjust the backset, some means must be provided to disengage the cam from the detent at the appropriate time. The simplest way to accomplish this is to make the arms of the cam narrower than the distance between the detents when the cam is in its rest position. The cam can then be moved to either of its two operating positions without interference. This method works, but in operation a certain amount of rotation is necessary before the cam begins to engage the detent, resulting in an undesirably large amount of total rotation. The instant invention remedies this problem.

SUMMARY OF THE INVENTION

The instant invention is directed to a tubular latch having an adjustable backset. The latch has a spring loaded bolt longitudinally reciprocating in a door mounted casing between a forward extended position projecting from a door edge and a rearward retracted position substantially fully within the door edge, latch operating means in a casing having a longitudinally forward and operably connected to the bolt and longitudinally rearward end operably connected to an actuation means, the actuation means being rotatable about a transverse axis to displace the operating means to reciprocate the bolt.

The operating means comprises a draw bar having a hook engaging the bolt at its longitudinally forward end and two pairs of horizontally spaced apart transversely extending detents adjacent its longitudinally rearward end. The actuation means comprise a collapsible roller cam assembly divided into two half hubs, each having one arm so that one hub operates the drawbar upon rotation of the roller cam assembly in one direction and the other half hub operates the drawbar upon rotation of the roller cam assembly in the other direction. Each half hub has a polygonal hole through its center of rotation adapted to receive a complementary shaped spindle. The two half hubs can be rotated relative to each other. When the hubs are set to one of the two backsets and are in a position to operate the drawbar, the polygonal holes through the two hub halves are aligned so that a spindle of the same polygonal shape can pass through both hubs and engage them for rotation. When a spindle is inserted into the hubs, they are prevented from rotating relative to each other and, in effect, are a solid hub. In this condition, the distance between the hub arms is greater than the distance between the drawbar detents and the cam assembly cannot be moved from one position to the other.

When the spindle is not in place, the two hub halves can rotate with respect to each other so that the distance between the ends of the hub arms becomes shorter and the hub assembly can pass between the drawbar detents from one bracket position to another.

BRIEF DESCRIPTION OF THE DRAWINGS

In the drawings which illustrate embodiments of the present invention.

DESCRIPTION OF THE PREFERRED EMBODIMENT

Figure 1:
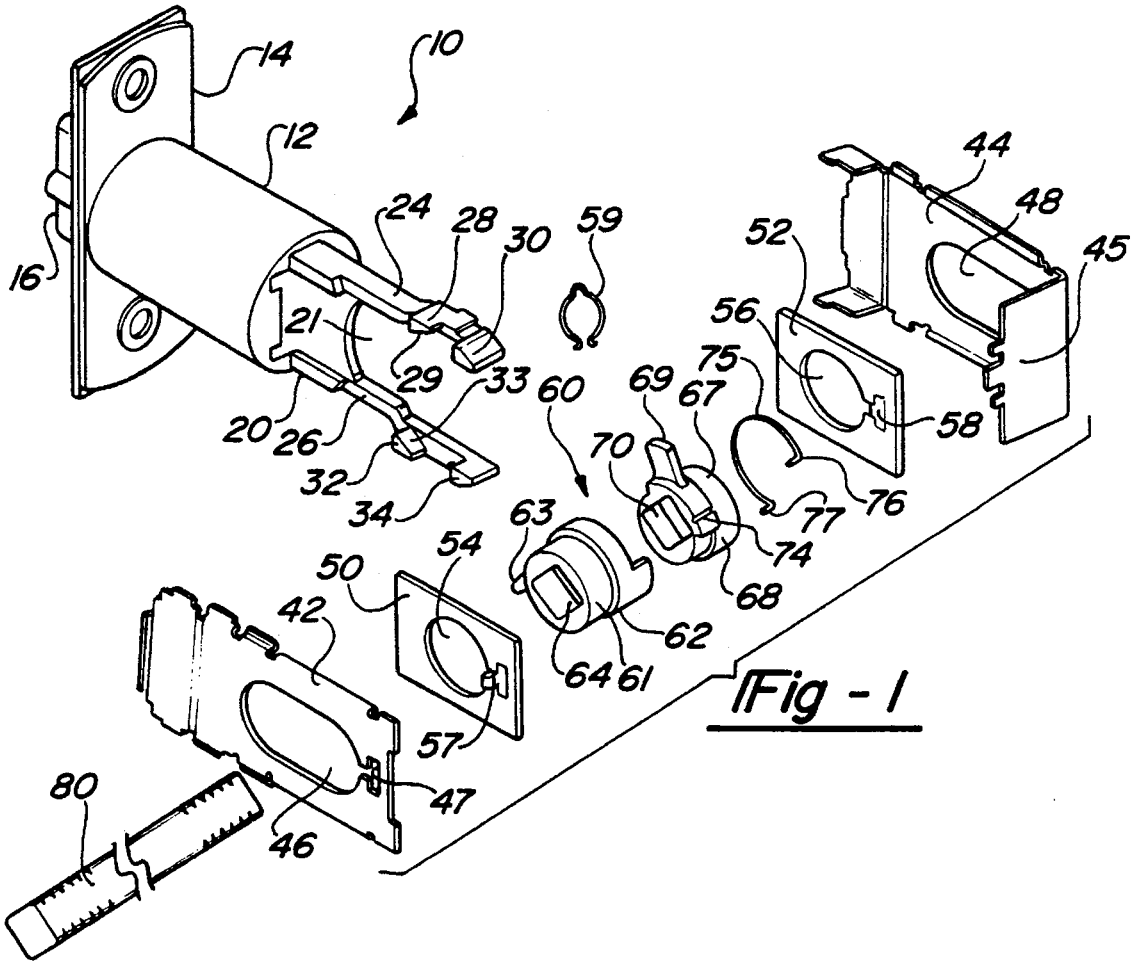
FIG. 1 is an exploded perspective view showing the various components of the latch assembly according to the present invention.
Figure 3:
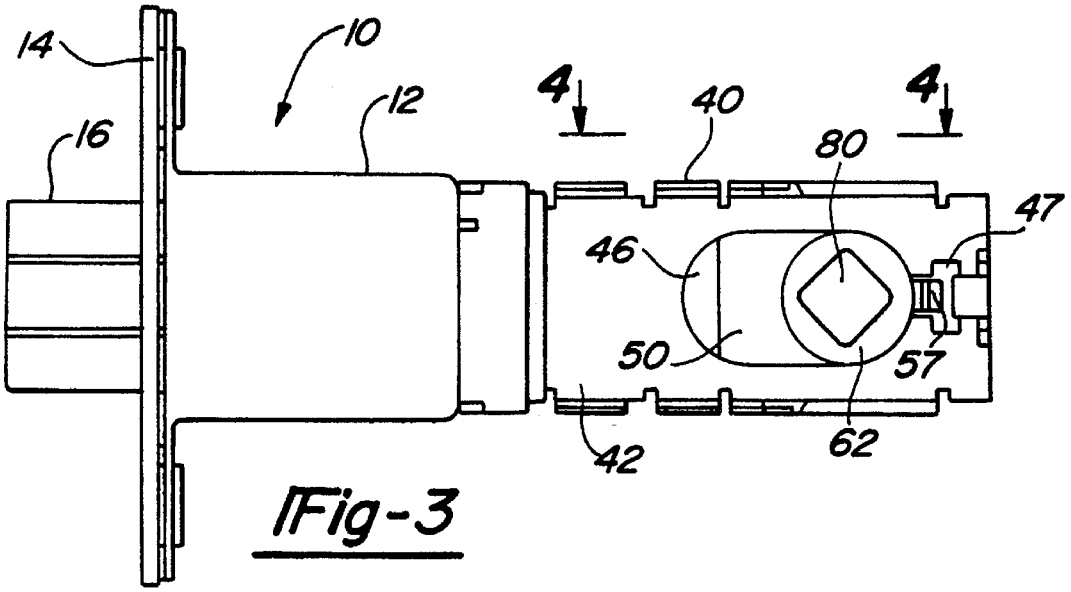
FIG. 3 is a side elevational view of the latch assembly with the backset adjusted in its rear position.
Figure 5:
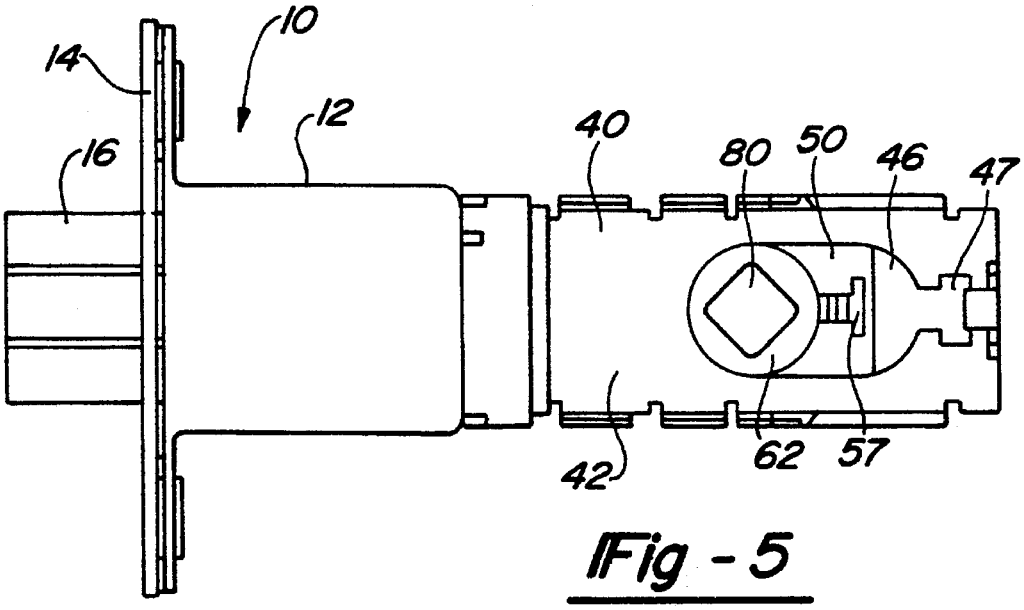
FIG. 5 is a side elevational view of the latch assembly with the backset adjusted in its front position.

Referring to FIGS. 1, 3 and 5 latch bolt assembly is generally shown as indicated by reference numeral 10. Latch bolt assemblies of this general type are known and comprise a generally cylindrical bolt housing 12 which is inserted into a bore in the edge of the door and secured there by means of a face plate 14. Extending axially from the bolt housing 12 is a bolt 16, shown in FIGS. 1, 3 and B projecting to the left of face plate 14. The bolt 16 is mounted for reciprocating motion in bolt housing 12. A latch operating plate or drawbar 20 is operably connected to the bolt 16 by means of a latch hook 22. The operation of latch hook 22 and its interaction with bolt 16 is conventional and well known in the art.

The drawbar 20 includes a pair of longitudinally extending spaced apart legs 24, 26 defining a slot 21 therebetween. Leg 24 has two laterally extending, longitudinally spaced apart detents, front detent 28 and rear detent 30. Leg 26 also has two laterally extending, longitudinally spaced apart detents, front detent 32 and rear detent 34. Front detent 28 has a beveled or ramped rear face 29. Front detent 32 also has a beveled or ramped rear face 33.

The drawbar 20 is disposed within latch works housing 40. Latch works housing is comprised of two housing plates 42, 44. Plates 42, 44 are attached to the bolt housing 12 at their front ends and to each other at their rear ends by bent section 45 of plate 44. Plate 42 contains a generally elliptical cam opening 46. Plate 44 also contains a generally elliptical cam opening 48.

Contained within the latch works housing 40 are cam assembly retainers 50 and 52. Cam assembly retainers 50 and 52 are two plates having openings 54, 56 therein. Openings 54, 56 are sized to accept the lateral rims of the cam assembly.

The cam assembly 60 is comprised of two parts or half hubs 62, 68. Each half hub has a camming arm 63, 69, respectively, so that one half hub 68 operates the drawbar 20 upon rotation in a clockwise direction while the other half hub 62 operates the drawbar 20 upon rotation in a counterclockwise direction. More specifically, upon clockwise rotation of the cam assembly 60 camming arm 69 of half hub 68, depending upon the backset adjustment, abuts detent 28 or 30 and draws the drawbar to the rear. Upon counterclockwise rotation of the cam assembly 60 camming arm 63 of half hub 62, depending upon the backset adjustment, abuts detents 32 or 34.

Figure 6:
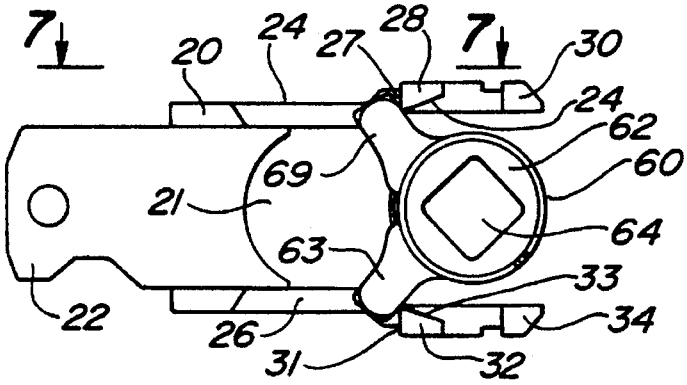
FIG. 6 is a side elevational view of the roller cam assembly and the drawbar with the backset adjusted in the front position.
Figure 7:
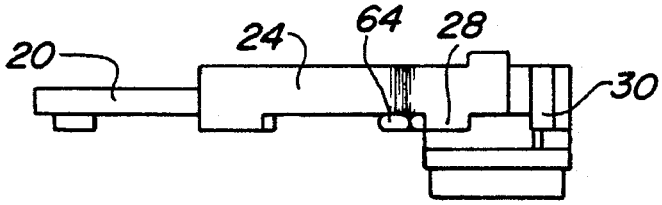
FIG. 7 is a top plan view of FIG. 6 taken along line 6—6.

FIG. 6 illustrates a front backset adjustment. Upon clockwise rotation of the cam assembly 60 camming arm 69 abuts against the front face 27 of detent 28. Upon counterclockwise rotation of the arm assembly 60 camming arm 63 abuts against the front face 31 of detent 32.

Figure 9:
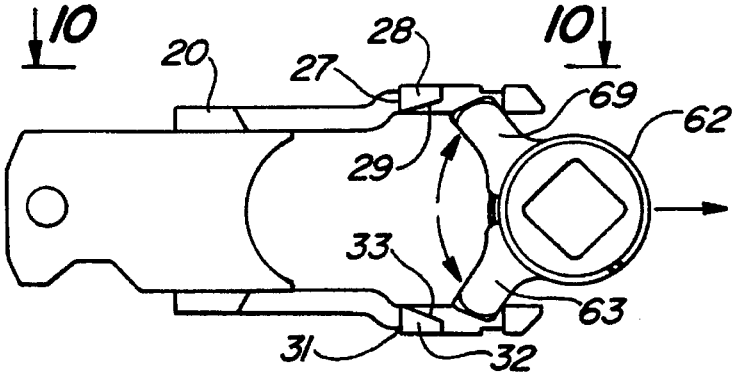
FIG. 9 is a view similar to FIG. 6 except that the backset adjustment is in the rear position.
Figure 10:
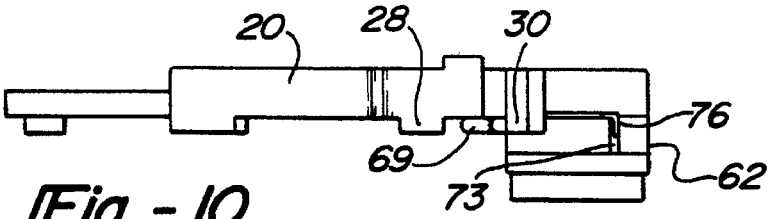
FIG. 10 is a top plan view of FIG. 9 taken along lines 10—10.
Figure 16:
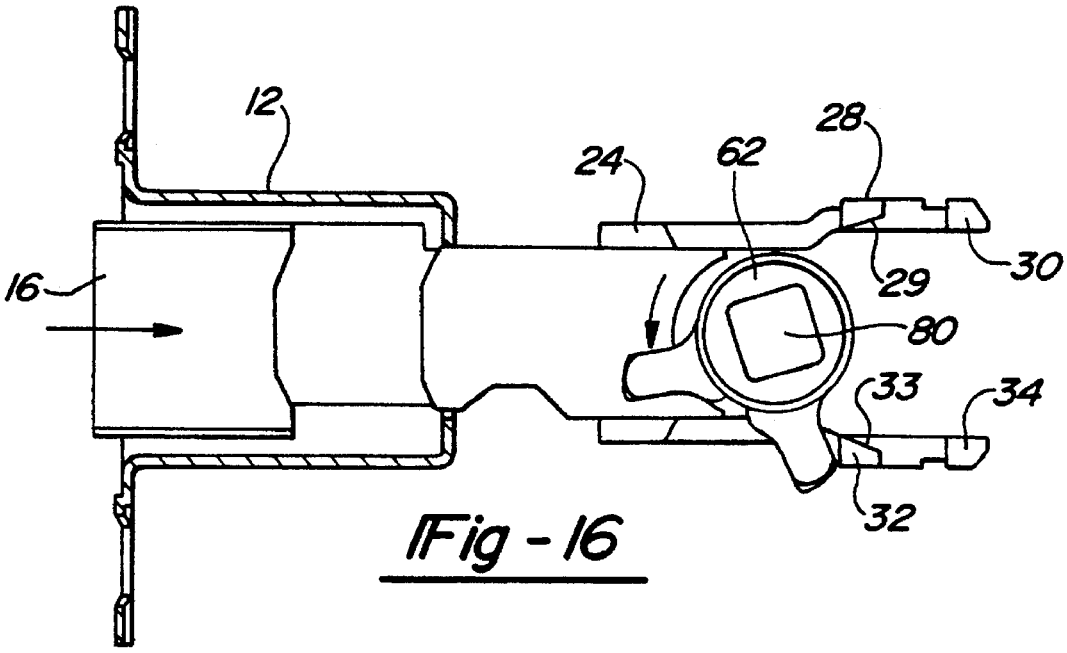
FIG. 16 is a side elevational view in partial section showing the drawbar and roller cam assembly backset in the front position, with the roller cam assembly being rotated to engage the drawbar and withdraw the latch bolt into the latch case.

FIGS. 9 and 16 illustrate a rear backset adjustment. Upon counterclockwise rotation of the cam assembly 60 camming arm 69 abuts against the front face 35 of rear detent 30. Upon counterclockwise rotation, as illustrated in FIG. 16, arm 63 abuts against the front face 35 of detent 34.

Each half hub 62, 68 has an opening 64, 70, respectively, extending axially therethrough. The openings 64, 70 are generally polygonal in cross section, usually square or rectangular. They are sized to receive spindle 80.

Figure 2:
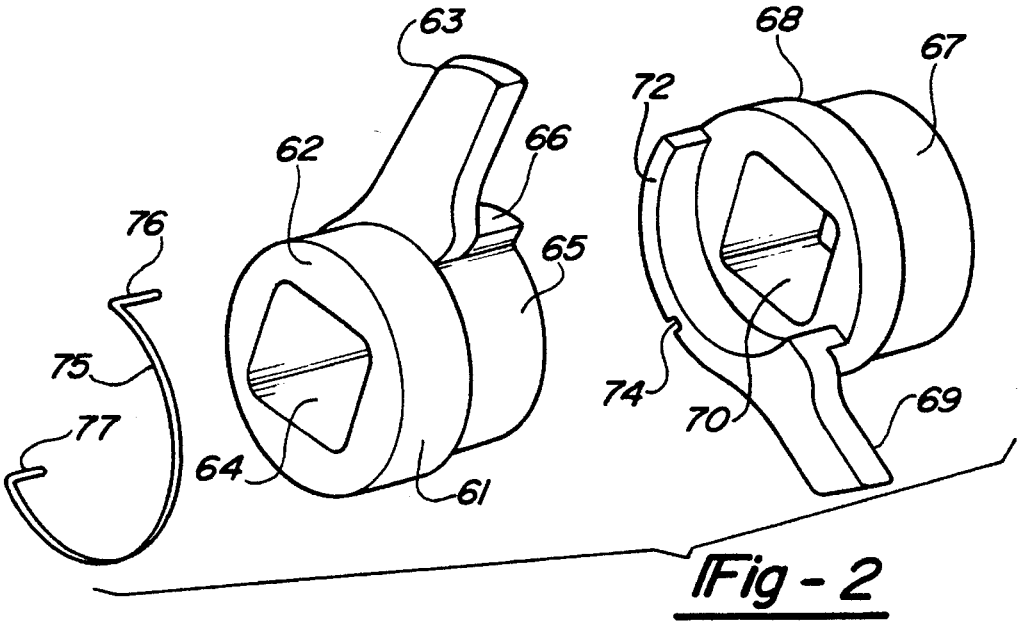
FIG. 2 is an enlarged, exploded perspective view of the two sections of the roller cam assembly.
Figure 17:
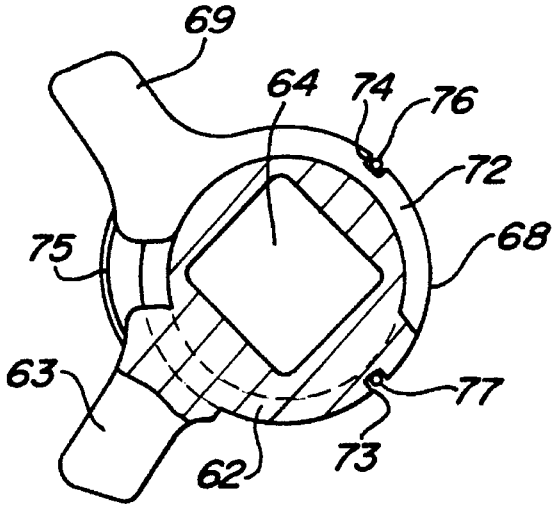
FIG. 17 is a side elevational view in section showing the roller cam assembly in an extended position.
Figure 18:
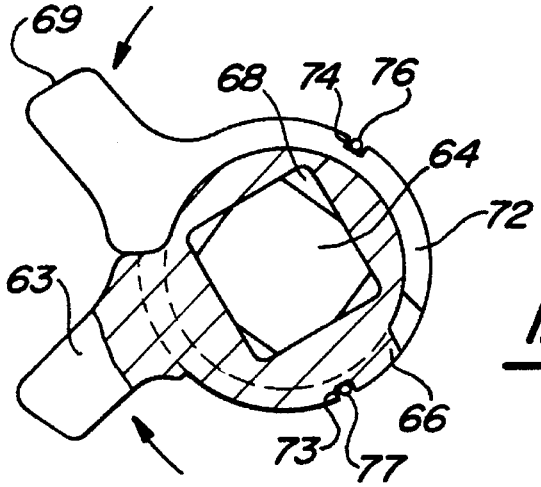
FIG. 18 is a view similar to FIG. 16 except that the roller cam assembly is in a compressed or collapsed position.

The centers of the half hubs 62, 68 are formed so that the two half hubs can rotate relative to each other. In the embodiment illustrated in the drawing, particularly FIGS. 2, 17 and 18, raised portion 72 of half hub 68 rests in a depressed portion 65 of half hub 62. Depressed portion 65 has a greater arc than raised portion 72, so that the two half hubs can rotate relative to each other a set amount as illustrated in FIGS. 17 and 18. FIG. 17 illustrates the two hubs rotated so that the distance between the two arms 63, 69 is at a maximum. In this position the cam assembly is not able to pass between detents 28, 32 from one backset position to another backset position. Also in this position the openings 64 and 70 are aligned and the complementary shaped spindle 80 can be inserted through both openings and prevent rotation of the two half hubs relative to each other.

With the spindle 80 removed the two half hubs can be rotated relative to each other so that the distance between the two arms 63, 69 is at a minimum as illustrated in FIG. 18. In this position the cam assembly is able to pass between detents 28, 32 from one backset position to another.

In the embodiment illustrated in the figures the cam assembly is spring loaded so that the spring 75 biases the two half hubs to the open or expanded position shown in FIG. 17. Spring 75 contains two laterally extending ends 76 and 77 which fit into grooves 74 and 73 in the two half hubs.

When the two hub halfs are set to one of the two backsets and are in a position to operate the drawbar, the non-circular holes in the two hub halves are aligned so that a spindle of the same non-circular shape can pass through both hubs and engage them for rotation. When a spindle is inserted into the half hubs, they are prevented from rotating relative to each other and, in effect, are a solid hub. In this condition, the distance between the arms 63, 69 is greater than the distance between the detents 28, 32 and the cam assembly cannot be moved from one position to the other.

When the spindle is not in place, the two hub halves can rotate with respect to each other so that the distance between the ends of the arms 63, 69 becomes shorter and the cam assembly is able to pass between the detents from one position to the other.

FIG. 6 illustrates the cam assembly 60 in the front backset position with the cam arms 69, 63 in the extended position. If the spindle 80 is inserted into the aligned openings 64, 70, the hub halves cannot be rotated and the cam assembly cannot be moved past detents 28, 32 to the backset position.

Figure 8:
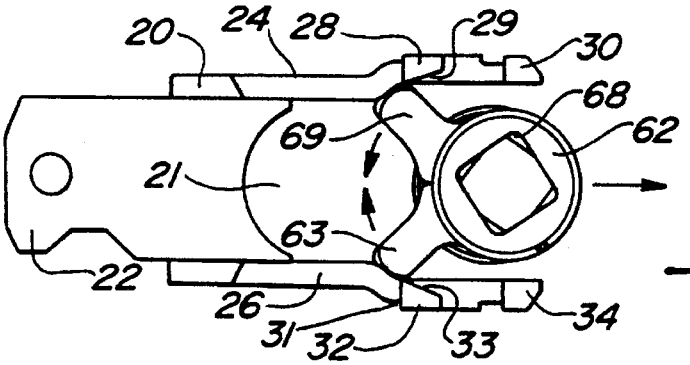
FIG. 8 is a side elevational view similar to FIG. 6 except that the backset adjustment is in the process of being changed from the front to the rear position.

To change the backset to the rear position, illustrated in FIGS. 3, 9 and 16, the spindle is removed from holes 64 and 74 and the cam assembly is moved to the rear (to the right in the figures). As illustrated in FIG. 8 the arms 63, 69 abut against detents 32, 28. This causes rotation of the two hub halves and moves the two arms 63, 69 toward each other. Since the distance between arms 63, 69 becomes less than the distance between detents 28, 32 the cam assembly is able to pass between detents 28, 32 and into the rear backset position illustrated in FIGS. 3, 9 and 16. When the cam assembly passes the detents 28, 32 into the rear position spring 75 biases the two hub halves to rotate in the opposite direction and spreads the arms 63, 69 apart, as illustrated in FIG. 8. The spindle 80 can then be inserted into holes 64, 70 to lock the two hub halves against relative rotation. The cam assembly 60 is thus unable to move past the detents 28, 32 into the forward backset position.

Figure 11:
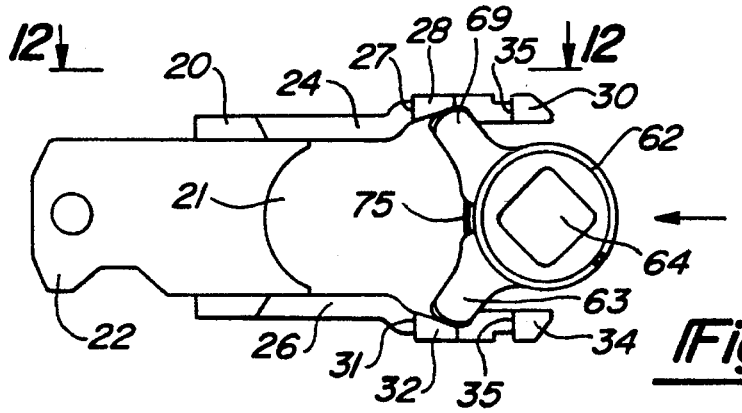
FIG. 11 is a view similar to FIG. 6 except that the backset is in the process of being changed from the rear to the front position.
Figure 12:
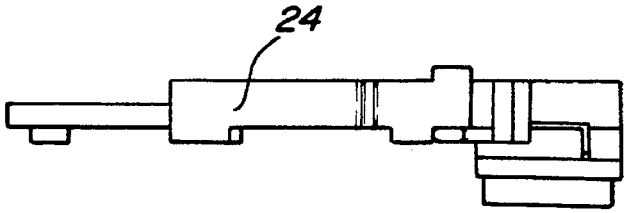
FIG. 12 is a top plan view of FIG. 11 taken along lines 12—12.
Figure 13:
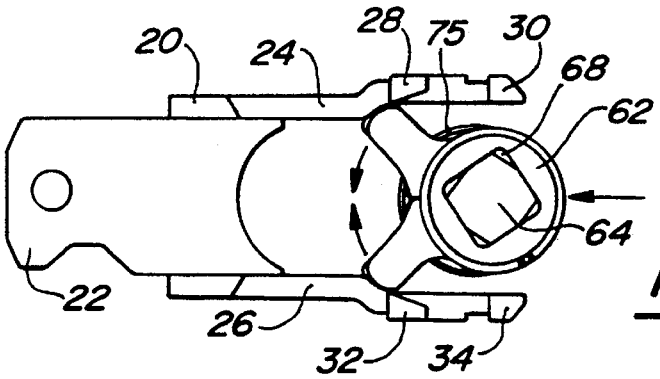
FIG. 13 is a view similar to FIG. 11 except that the change of the backset from the rear to the front position is further along than in FIG. 11.
Figure 14:
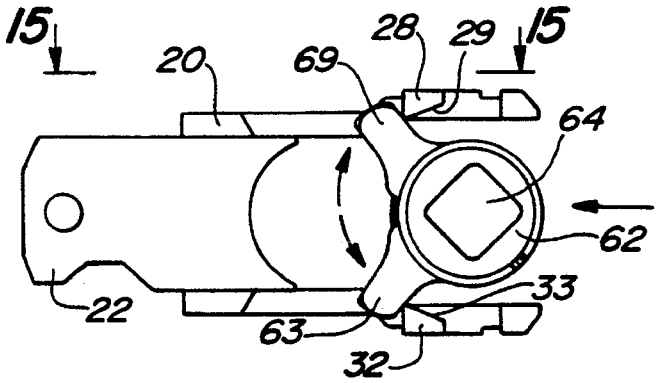
FIG. 14 is a view similar to FIG. 13 except that the change of the backset from the rear to the front position is complete.
Figure 15:
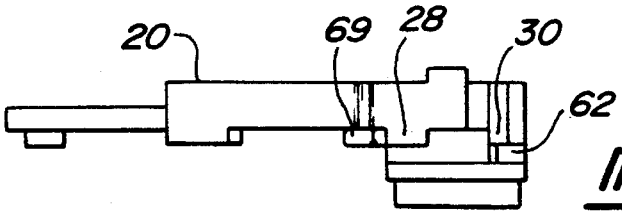
FIG. 15 is a top plan view of FIG. 14 taken along lines 15—15.

To move the cam assembly from the rear position to the front or forward position illustrated in FIGS. 5, 6 and 14, the spindle 80 is removed and the cam assembly is pushed to the front (left in the figures). As illustrated in FIG. 11 movement of the cam assembly 60 to the left results in arms 63, 69 abutting the beveled rear faces 29, 33 of detents 28, 32. This results in the two hub halves 62, 68 rotating relative to each other and the arms 63, 69 coming closer together.

In FIG. 14 the cam assembly 60 is past the detents 28, 32 and the two hub halves 62, 68 begin to rotate outwardly, thereby increasing the distance between arms 63, 68 under the force of spring 75.

Because the hub halves are spring loaded, they can collapse in only one direction. For this reason, they can easily be moved from the front position to the rear position, but attempting to move them from the rear to the front position tends to rotate them in the wrong direction, making it difficult to return them to the short (front) backset position once they have been moved to the long (rear) backset position. This problem has been solved by forming the inner rear faces 29, 33 of the front set of detents 28, 32 in a beveled or ramp shape and shaping the ends of the hub arms 63, 69 so that the initial point of contact between the hub arm and the detent is on the ramp shaped section of the detent when the hub assembly is moved from the long backset position to the short backset position as best illustrated in FIG. 11.

Figure 4:
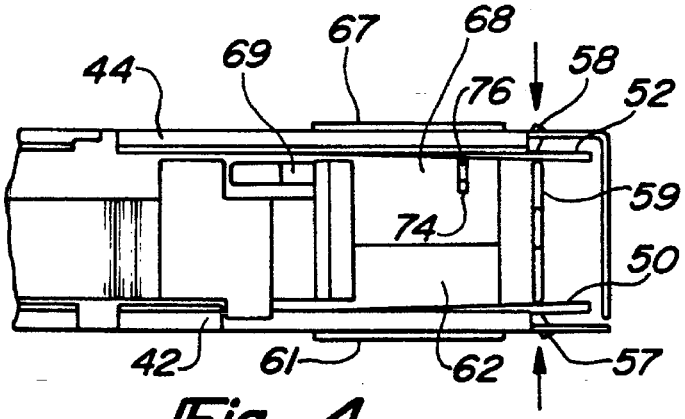
FIG. 4 is a partial top plan view of the latch assembly of FIG. 3.

Cam assembly retaining plates 50 and 52 have outwardly projecting tabs 57, 58. These tabs 57, 58 engage tab openings 47 in housing plates 42, 44 when the cam assembly is in the rear backset position as illustrated in FIG. 3. A spring 59 disposed between plates 50, 52 biases them outwardly and insures that tabs 57, 58 project into tab openings 47. To move the cam assembly from the rear backset position illustrated in FIGS. 3 and 4 to the front backset position illustrated in FIG. 5 the two tabs are pushed inwardly against the force of the opening 57, 58 and plates 50, 52 are moved forward (to the left in FIG. 3) thereby carrying the cam assembly with them.

I claim:

1. A latch assembly having a backset adjustment for mounting in a door comprising a bolt longitudinally reciprocating in a housing between a forward extended position and a rearward retracted position;

latch operating means operably connected to said bolt and operably connected to rotatable, collapsible actuation means, said latch operating means including a front pair of engagement means and a rear pair of engagement means longitudinally spaced apart, each pair of engagement means comprising two horizontally spaced apart detents;

spindle for rotation of said actuation means;

said collapsible actuation means being rotatable about a transverse axis to displace said operating means to reciprocate said bolt and comprising two half hubs rotatable relative to each other having an opening extending axially therethrough adapted to removably receive a complementary shaped spindle, said half hubs being locked against rotation relative to each other with said spindle inserted through said half hub openings and free to rotate relative to each other with said spindle removed from said openings, each half hub including one radial arm adapted to engage one of said detents of one pair of engagement means upon rotation of said half hub, whereby upon rotation of at least one of said half hubs in one direction relative to said other half hub the distance between said arms becomes smaller than the distance between said detents of one pair of engagement means and said actuation means is in a collapsed condition and said actuation means is able to pass between said one pair of engagement means to vary the backset, and upon rotation of at least one of said hubs in the opposite direction the distance between said arms becomes larger than the distance between said detents of said front pair of engagement means and said actuation means is in an expanded condition and is unable to pass between said front pair of engagement means.

2. The latch assembly of claim 1 wherein said two pairs of engagement means comprise a first forward pair of engagement means and a second rearward pair of engagement means spaced longitudinally apart from said first pair of engagement means.

3. The latch assembly of claim 1 wherein said operating means comprises a drawbar having two longitudinally extending horizontally spaced apart legs.

4. The latch assembly of claim 3 wherein said first forward pair of engagement means comprises a first transversely extending detent on one of said longitudinally extending legs and a second transversely extending detent on the other of said longitudinally extending legs.

5. The latch assembly of claim 4 wherein said first and second detents have a front face and a rear face with said rear face being shaped so that the initial contact between said arms of said half hub and said first and second detents when moving said actuation means longitudinally from a rear backset position wherein said actuation means is disposed intermediate said front and rear pair of detents to a front backset position wherein said actuation means is disposed forward of said front pair of detents is on the ramp shaped rear face of said front pair of detents.

6. The latch assembly of claim 1 wherein said half hubs are spring loaded so that they are biased to the expanded position.

7. The latch assembly of claim 1 wherein said half hub opening is non-circular shaped.

8. The latch assembly of claim 7 wherein said opening is polygonal shaped.

9. The latch assembly of claim 7 wherein said opening is square in shape.

10. The latch assembly of claim 7 wherein said opening is rectangular in shape.

* * * * *